US009041970B2

(12) United States Patent
Itoh

(10) Patent No.: US 9,041,970 B2
(45) Date of Patent: May 26, 2015

(54) IMAGE PROCESSING APPARATUS, IMAGE PROCESSING METHOD, AND COMPUTER PROGRAM PRODUCT FOR DETERMINING A DIRECTION OF TRANSPARENT COLOR MATERIAL PATTERN BASED ON ACQUIRED GRAIN DIRECTION

(71) Applicant: Takanori Itoh, Kanagawa (JP)

(72) Inventor: Takanori Itoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/335,564

(22) Filed: Jul. 18, 2014

(65) Prior Publication Data

US 2015/0029520 A1 Jan. 29, 2015

(30) Foreign Application Priority Data

Jul. 23, 2013 (JP) ..... 2013-153088

(51) Int. Cl.
*G03G 15/00* (2006.01)
*G03G 15/01* (2006.01)

(52) U.S. Cl.
CPC ..... *G03G 15/5062* (2013.01); *G03G 15/01* (2013.01)

(58) Field of Classification Search
CPC ..... G03G 15/5062; G03G 15/01
USPC ..... 358/1.1, 1.18
See application file for complete search history.

(56) References Cited

U.S. PATENT DOCUMENTS

| | | | | |
|---|---|---|---|---|
| 6,206,516 | B1 * | 3/2001 | Moriyama et al. | 347/101 |
| 2005/0118922 | A1 * | 6/2005 | Endo | 445/24 |
| 2010/0207985 | A1 * | 8/2010 | Takahashi et al. | 347/14 |
| 2011/0157265 | A1 * | 6/2011 | Itogawa | 347/9 |
| 2012/0134696 | A1 | 5/2012 | Kobayashi et al. | |
| 2013/0003088 | A1 * | 1/2013 | Feng | 358/1.9 |
| 2013/0064588 | A1 * | 3/2013 | Akita | 399/341 |
| 2013/0291750 | A1 * | 11/2013 | Hirano | 101/481 |
| 2014/0140710 | A1 * | 5/2014 | Yoshimura et al. | 399/9 |
| 2014/0333970 | A1 * | 11/2014 | Jinno | 358/3.24 |

FOREIGN PATENT DOCUMENTS

| | | |
|---|---|---|
| JP | 11-002916 | 1/1999 |
| JP | 2012-133323 | 7/2012 |
| JP | 2012-175131 | 9/2012 |

* cited by examiner

*Primary Examiner* — Benny Q Tieu
*Assistant Examiner* — Quyen V Ngo
(74) *Attorney, Agent, or Firm* — Duft Bornsen & Fettig LLP

(57) ABSTRACT

An image processing apparatus includes: a protected area determining unit that determines a protected area to be protected by forming a transparent color material pattern made of a transparent color material on recording paper; a grain-direction acquiring unit that acquires a grain direction of the recording paper; a pattern determining unit that determines a direction of the transparent color material pattern based on the acquired grain direction; a pattern generating unit that generates the transparent color material pattern in the determined direction; and a color material forming unit that forms the transparent color material pattern in the determined direction on the protected area of the recording paper.

7 Claims, 7 Drawing Sheets

IMAGE PROCESSING APPARATUS, IMAGE PROCESSING METHOD, AND COMPUTER PROGRAM PRODUCT FOR DETERMINING A DIRECTION OF TRANSPARENT COLOR MATERIAL PATTERN BASED ON ACQUIRED GRAIN DIRECTION

CROSS-REFERENCE TO RELATED APPLICATION(S)

The present application claims priority to and incorporates by reference the entire contents of Japanese Patent Application No. 2013-153088 filed in Japan on Jul. 23, 2013.

BACKGROUND OF THE INVENTION

1. Field of the Invention

The present invention relates to an image processing apparatus, an image processing method, and a computer program product.

2. Description of the Related Art

To record a color image, typically used are toners or inks of four colors of cyan (C), magenta (M), yellow (Y), and black (K), for example. In recent years, there have been developed technologies for applying a protective material to protect an image. Colorless and transparent resin (e.g., a clear toner) is frequently used as the protective material.

Japanese Patent Application Laid-open No. 11-002916 discloses a configuration that uniformly forms an image surface protecting layer on the surface of recording paper to prevent a toner image from rubbing off, for example.

Japanese Patent Application Laid-open No. 2012-175131 discloses a configuration that determines image arrangement based on the direction of an image, the paper-fiber (grain) direction of recording paper, and the light incident direction so that the image can be recorded in a direction to provide preferable glossiness in consideration of observation conditions.

The technology disclosed in Japanese Patent Application Laid-open No. 11-002916 simply forms the image surface protecting layer uniformly. Thus, the technology consumes a large amount of protective material to protect the image and the recording paper. In the technology disclosed in Japanese Patent Application Laid-open No. 2012-175131, the observation conditions have no relation with protection of the recording paper. Thus, the technology also consumes a large amount of protective material to protect the image and the recording paper as in the technology disclosed in Japanese Patent Application Laid-open No. 11-002916.

Therefore, it is desirable to provide an image processing apparatus, an image processing method, and a computer program product that can reduce the consumption of a transparent color material without reducing a reinforcing effect for recording paper and an image.

SUMMARY OF THE INVENTION

It is an object of the present invention to at least partially solve the problems in the conventional technology.

According to an aspect of the present invention, there is provided an image processing apparatus including: a protected area determining unit that determines a protected area to be protected by forming a transparent color material pattern made of a transparent color material on recording paper; a grain-direction acquiring unit that acquires a grain direction of the recording paper; a pattern determining unit that determines a direction of the transparent color material pattern based on the acquired grain direction; a pattern generating unit that generates the transparent color material pattern in the determined direction; and a color material forming unit that forms the transparent color material pattern in the determined direction on the protected area of the recording paper.

According to another aspect of the present invention, there is provided an image processing method including: determining, by a protected area determining unit, a protected area to be protected by forming a transparent color material pattern made of a transparent color material on recording paper; acquiring, by a grain-direction acquiring unit, a grain direction of the recording paper; determining, by a pattern determining unit, a direction of the transparent color material pattern based on the acquired grain direction; generating, by a pattern generating unit, the transparent color material pattern in the determined direction; and forming, by a color material forming unit, the transparent color material pattern in the determined direction on the protected area of the recording paper.

According to still another aspect of the present invention, there is provided a computer program product including a non-transitory computer-readable medium having computer readable program codes, performed by a computer, the program codes when executed causing the computer to execute: determining a protected area to be protected by forming a transparent color material pattern made of a transparent color material on recording paper; acquiring a grain direction of the recording paper; determining a direction of the transparent color material pattern based on the acquired grain direction; generating the transparent color material pattern in the determined direction; and forming the transparent color material pattern in the determined direction on the protected area of the recording paper.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of an image processing apparatus, an image processing method, and an computer program product according to the present invention are described below in greater detail with reference to the accompanying drawings.

First Embodiment

Figure 1:
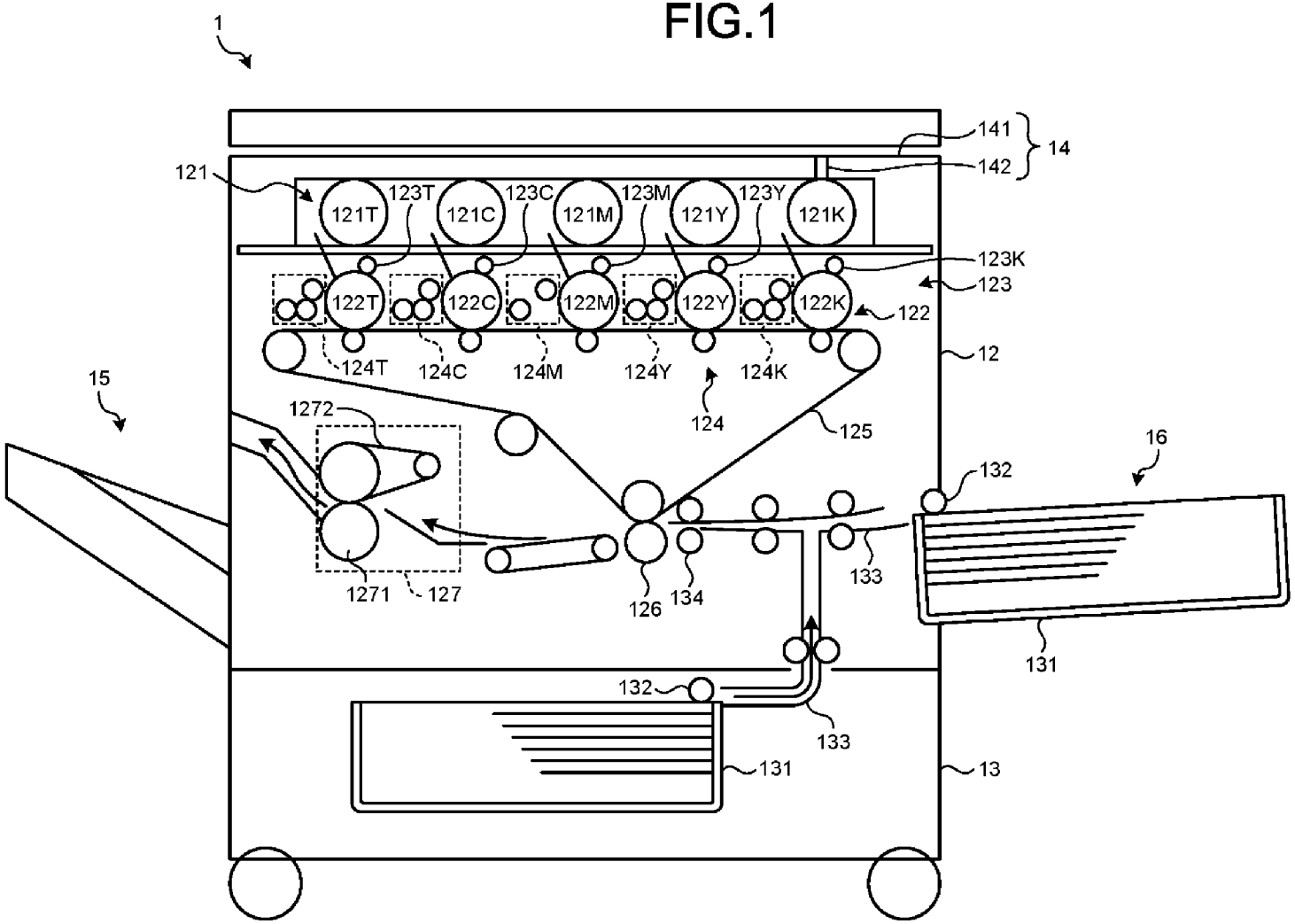
FIG. 1 is a schematic of the hardware configuration of an image forming apparatus according to a first embodiment.

FIG. 1 is a schematic of the hardware configuration of an image forming apparatus 1 to which the image processing apparatus, the image processing method, and the computer program product are applied. As illustrated in FIG. 1, the image forming apparatus 1 includes a printer 12, a paper feeding unit 13, a scanner 14, a paper discharging unit 15, a paper feeding unit 16, and a control unit 10, which is not illustrated in FIG. 1.

The printer 12 includes cartridges 121, photosensitive drums 122, charging units 123, developing units 124, an intermediate transfer belt 125, a pair of secondary transfer rollers 126, and a fixing unit 127. The fixing unit 127 includes a pair of pressing rollers 1271 and a fixing belt 1272.

The cartridges 121 accommodate color toners of cyan (C), magenta (M), yellow (Y), and black (K) and a clear (T) toner. The cartridges 121 include five cartridges 121C, 121M, 121Y, 121K, and 121T corresponding to the respective toners. In the description below, an arbitrary cartridge out of the cartridges 121C, 121M, 121Y, 121K, and 121T is referred to as the "cartridge 121".

The clear toner used in the present embodiment is a colorless and transparent toner formed of resin containing no colorant. The clear toner covers the surface of recording paper, thereby preventing a color toner fixed on the recording paper from rubbing off of the recording paper. In addition, the clear toner has a recording paper protecting effect to make the recording paper itself hard to be torn.

The surface of the photosensitive drum 122 is uniformly charged by the charging unit 123, whereby an electrostatic latent image corresponding to image information received from the control unit 10 is formed on the surface. The developing unit 124 causes a toner to adhere to the surface of the photosensitive drum 122 on which the electrostatic latent image is formed, whereby an image is formed. The photosensitive drums 122 include five photosensitive drums 122C, 122M, 122Y, 122K, and 122T corresponding to the toners of C, M, Y, K, and T, respectively. In the description below, an arbitrary photosensitive drum out of the photosensitive drums 122C, 122M, 122Y, 122K, and 122T is referred to as the "photosensitive drum 122".

The charging unit 123 comes into contact with the photosensitive drum 122 and applies a voltage, thereby charging the surface of the photosensitive drum 122. The charging units 123 include five charging units 123C, 123M, 123Y, 123K, and 123T corresponding to the toners of C, M, Y, K, and T, respectively. In the description below, an arbitrary charging unit out of the charging units 123C, 123M, 123Y, 123K, and 123T is referred to as the "charging unit 123". The charged surface of the photosensitive drum 122 is irradiated with laser scanning light biased based on a color toner adhesion amount and a clear toner adhesion amount determined by a toner adhesion amount determining unit. Thus, an electrostatic latent image is formed on the surface of the photosensitive drum 122.

The developing unit 124 causes the toner in the cartridge 121 to adhere to the electrostatic latent image formed on the photosensitive drum 122, thereby forming an image on the surface of the photosensitive drum 122. The developing unit 124 includes five developing units 124C, 124M, 124Y, 124K, and 124T corresponding to the toners of C, M, Y, K, and T, respectively. In the description below, an arbitrary developing unit out of the developing units 124C, 124M, 124Y, 124K, and 124T is referred to as the "developing unit 124".

The intermediate transfer belt 125 moves forward in contact with the photosensitive drum 122, whereby an image is transferred onto the surface thereof. The secondary transfer rollers 126 and the intermediate transfer belt 125 sandwich therebetween recording paper conveyed from the paper feeding unit 13, which will be described later. Thus, the image formed by the toner adhering to the intermediate transfer belt 125 is transferred onto the recording paper. The secondary transfer rollers 126 then convey the recording paper to the fixing unit 127.

The fixing unit 127 includes the pressing rollers 1271 and the fixing belt 1272. The fixing unit 127 fixes an image on the recording paper conveyed from the secondary transfer rollers 126. The pressing rollers 1271 press the recording paper against the fixing belt 1272 and applies heat to the recording paper, thereby fixing the image formed by the toner adhering to the recording paper. The fixing belt 1272 presses the recording paper against the pressing rollers 1271, thereby fixing the image on the recording paper.

The following describes the hardware configuration of the paper feeding units 13 and 16, which are examples of a storage unit. The paper feeding units 13 and 16 supply recording paper to the printer 12 and each include a paper feeding tray 131, a paper feeding roller 132, a paper feeding belt 133, and registration rollers 134.

Figure 2:
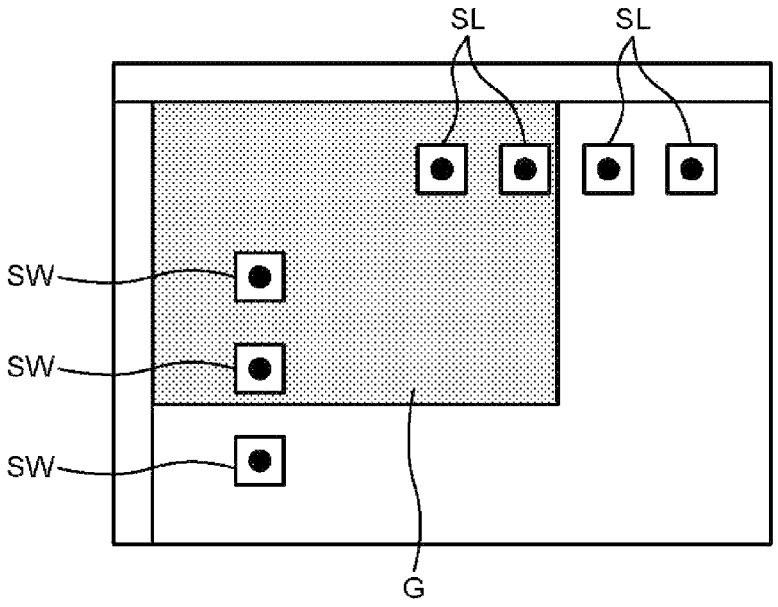
FIG. 2 is a schematic of a sheet sensor provided to the image forming apparatus according to the first embodiment.

The paper feeding tray 131 accommodates recording paper. The size and the direction of the recording paper accommodated in the paper feeding tray 131 are detected by a sheet sensor arranged near the paper feeding tray 131. As illustrated in FIG. 2, the sheet sensor includes a plurality of document length detection sensors SL and a plurality of document width detection sensors SW arranged on the bottom of the paper feeding tray 131, for example. The sheet sensor detects whether recording paper G is present above each of the detection sensors SL and SW. The sheet sensor uses a signal output from each of the detection sensors SL and SW to determine the size of the recording paper.

The paper feeding roller 132 pulls out the recording paper accommodated in the paper feeding tray 131 and places the recording paper on the paper feeding belt 133. The paper feeding belt 133 conveys and feeds the recording paper to the nip formed between the registration rollers 134. At this time, one of the paper feeding units 13 and 16 is selected. The registration rollers 134 feed the recording paper to the nip formed between the intermediate transfer belt 125 and the secondary transfer rollers 126.

The scanner 14 includes an exposure glass 141 and a scanning sensor 142. The scanner 14 scans image information depicted on recording paper. Recording paper on which an image is depicted is placed on the exposure glass 141. The scanning sensor 142 scans the image information depicted on the recording paper placed on the exposure glass 141. The paper discharging unit 15 discharges the recording paper on which the image is fixed by the fixing unit 127, and stores the discharged recording paper therein.

Figure 3:
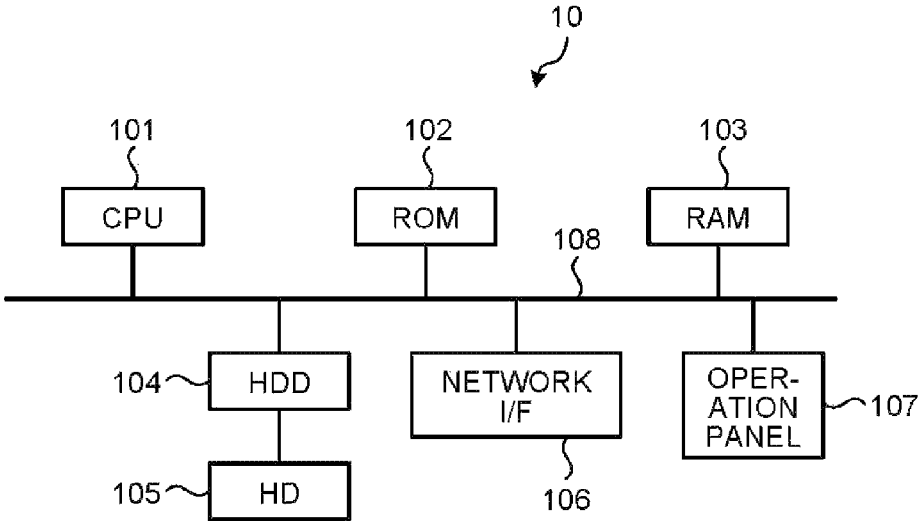
FIG. 3 is a block diagram of a control unit of the image forming apparatus according to the first embodiment.

FIG. 3 is a block diagram of the hardware configuration of the control unit 10 of the image forming apparatus 1. As illustrated in FIG. 3, the control unit 10 includes a central processing unit (CPU) 101, a read only memory (ROM) 102, and a random access memory (RAM) 103. The control unit 10 further includes a hard disk drive (HDD) 104, a hard disk (HD) 105, a network interface (I/F) 106, and an operation panel 107. The control unit 10 is formed of these components, the CPU 101 to the operation panel 107, connected to one another via a bus line 108. The operation panel 107 is an example of an input unit.

The CPU 101 executes an image formation program for forming an image. The ROM 102 stores therein a system start program, for example. The RAM 103 is used as a work area in which the CPU 101 executes a computer program. The HDD 104 controls reading or writing various types of data from or to the HD 105. The HD 105 is a storage device that stores therein data and is replaceable with an external storage device, such as a compact disc read only memory (CD-ROM), a compact disc recordable (CD-R), and a digital versatile disc (DVD).

The network I/F 106 transmits and receives various types of information to and from an external device, such as an information processor. The operation panel 107 receives an operational input from a user. The computer program stored in the ROM 102 may be recorded and provided in computer-readable recording medium, such as a CD-ROM, a CD-R, and a DVD, as an installable or executable file.

Figure 4:
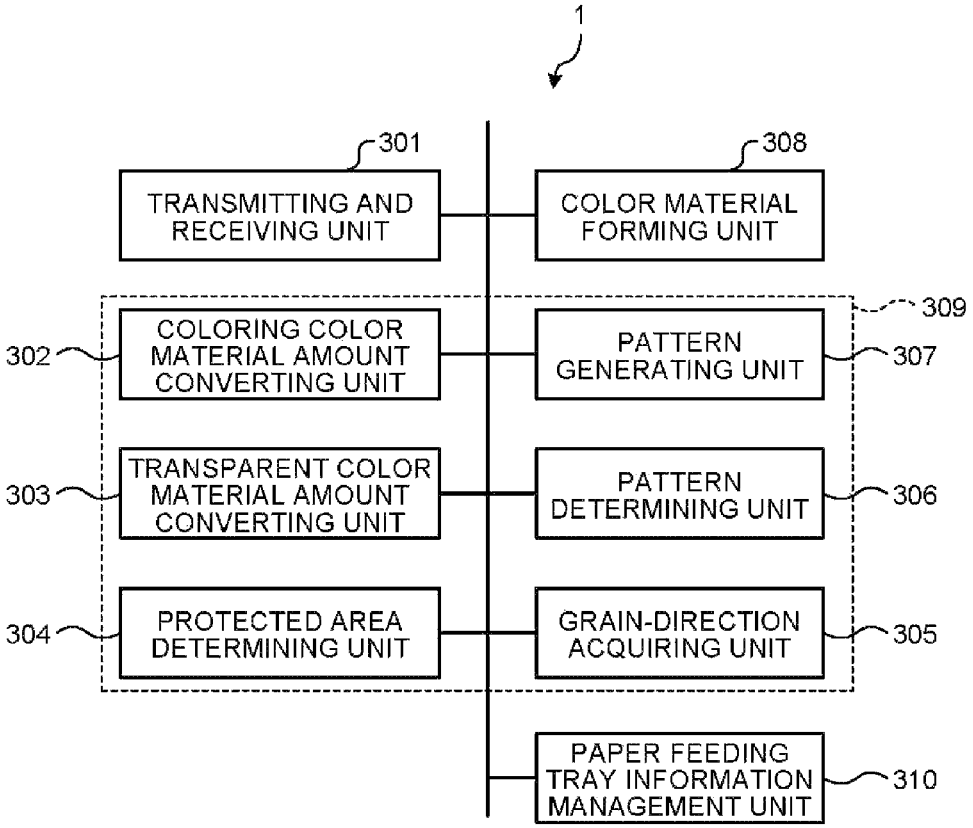
FIG. 4 is a functional block diagram of the image forming apparatus according to the first embodiment.

FIG. 4 is a functional block diagram of the image forming apparatus 1. The image forming apparatus 1 includes a transmitting and receiving unit 301, a color material forming unit 308, an image processing unit 309, and a paper feeding tray information management unit 310. The image processing unit 309 includes a coloring color material amount converting unit 302, a transparent color material amount converting unit 303, a protected area determining unit 304, a grain-direction acquiring unit 305, a pattern determining unit 306, and a pattern generating unit 307. The functions of the units 301 to 310 may be provided as software by the CPU 101 of the control unit 10 operating in accordance with the computer program stored in the ROM 102 illustrated in FIG. 3. Alternatively, some or all of the functions of the units 301 to 310 may be provided as hardware. The transmitting and receiving unit 301, for example, may be provided as the network I/F 106 illustrated in FIG. 3. The network I/F 106 receives image data and additional data transmitted from an information processor or the like and receives input of the image data and the additional data.

In this embodiment, image data is information indicating an image to be formed on recording paper with a coloring color material. Image data is bitmap or vector data represented by an RGB or CMYK color system or a monochrome grayscale system, for example. Additional data is information indicating an image to be formed on recording paper with a transparent color material. Additional data is bitmap or vector data represented by a monochrome grayscale system, for example.

The image processing unit 309 processes image data, additional data, and other data received by the transmitting and receiving unit 301 and converts the data into the recording amounts of the coloring color material and the transparent color material to be retained by the color material forming unit 308. The color material forming unit 308 uses the recording amounts obtained by the conversion made by the image processing unit 309 to form a color material image on the recording paper. In the description below, the recording amount of the coloring color material and the recording amount of the transparent color material are represented as dot area ratios. The values of the recording amounts of the respective color materials fall within a range from 0% to 100%. In the present embodiment, the recording amounts are not necessarily represented as described above. The recording amount of the coloring color material and the recording amount of the transparent color material may be represented as 8-bit values. In this case, the values of the recording amounts of the respective color materials fall within a range from 0 to 255.

The coloring color material amount converting unit 302 of the image processing unit 309 converts the image data received by the transmitting and receiving unit 301 into bitmap coloring color material amount data indicating the recording amount of the coloring color material to be retained by the color material forming unit 308. More specifically, the coloring color material amount converting unit 302 develops the vector image data into a bitmap. The coloring color material amount converting unit 302 also converts the colors of the image represented by the RGB color system into the recording amount of the coloring color material of CMYK or the like to be retained by the color material forming unit 308 to reproduce the colors in the color material forming unit 308. The coloring color material amount converting unit 302 also converts the colors of the image represented by the CMYK color system for another color material forming unit into the recording amount of the coloring color material of CMYK or the like to be retained by the color material forming unit 308 to reproduce the colors in the color material forming unit 308.

The transparent color material amount converting unit 303 converts the additional data received by the transmitting and receiving unit 301 into bitmap transparent color material amount data indicating the recording amount of the transparent color material to be retained by the color material forming unit 308. More specifically, the transparent color material amount converting unit 303 develops the vector additional data into a bitmap. The transparent color material amount converting unit 303 also converts the grayscale of the image represented by the monochrome grayscale system into the recording amount of the transparent color material to be retained by the color material forming unit 308 to record the grayscale in the color material forming unit 308.

The protected area determining unit 304 determines an area to be protected with the transparent color material. The user, for example, performs a selection operation to determine whether to make protection with the transparent color material, through the operation panel 107. If the user determines to make no protection with the transparent color material, no protection with the transparent color material is made as in the case of recording paper 31 in FIG. 5.

By contrast, if the user determines to make protection with the transparent color material through the operation panel 107, the user selects a protection form to protect the whole surface of the recording paper or a protection form to protect only the outer periphery of the recording paper. If the user selects the protection form to protect the whole surface of the recording paper, the whole surface is protected with the transparent color material as in the case of recording paper 32 in FIG. 5. If the user selects the protection form to protect only the outer periphery of the recording paper, the outer periphery alone is protected with the transparent color material as in the case of recording paper 33 in FIG. 5.

In addition to the selection of the protection form with the transparent color material, the user also selects a desired paper feeding unit out of the paper feeding unit 13 and the paper feeding unit 16. The paper feeding tray information management unit 310 manages the size and the direction of the recording paper detected by the sheet sensor. The protected area determining unit 304 uses parameters, including the protection form selected by the user and the size and the direction of the recording paper detected by the sheet sensor, to determine an area to be protected with the transparent color material.

The grain-direction acquiring unit 305 acquires the grain direction of the recording paper. The user, for example, operates the operation panel 107 to input in advance the grain direction of the recording paper accommodated in the paper feeding trays 131 of the paper feeding units 13 and 16. The paper feeding tray information management unit 310 manages the input grain direction. The grain-direction acquiring unit 305 notifies the paper feeding tray information management unit 310 of the paper feeding unit selected by the user out of the paper feeding units 13 and 16. The grain-direction acquiring unit 305 then inquires the grain direction of the recording paper in the paper feeding unit selected by the user. In response to the inquiry, the paper feeding tray information management unit 310 notifies the grain-direction acquiring unit 305 of the grain direction of the recording paper in the paper feeding unit selected by the user. Thus, the grain-direction acquiring unit 305 acquires the grain direction of the recording paper on which recording is to be performed.

Typically, with the recording paper in a portrait orientation, the type of recording paper whose grain extending in the longitudinal direction is referred to as a "long grain (T)", whereas the type of recording paper whose grain extending in the lateral direction is referred to as a "short grain (Y)". Such type information is frequently provided on package paper wrapping the paper, for example. Even if no type information is provided on the package paper, the user can easily determine the grain based on the stiffness of the paper shown when the user holds the center of the recording paper with hand. Thus, the user can input the grain direction of the recording paper based on the type provided on the wrapping paper or the stiffness shown when the user holds the center of the recording paper with hand, for example.

Without the user inputting the grain direction of the recording paper accommodated in the paper feeding trays 131 of the paper feeding units 13 and 16, a two-dimensional image sensor may scan the accommodated recording paper, thereby detecting the grain direction, for example. As described above, the grain of the recording paper is formed because paper fibers are caused to uniformly follow one direction when the paper is made. Scanning the paper fibers with the two-dimensional image sensor or the like can detect the grain of the recording paper.

Figure 6:
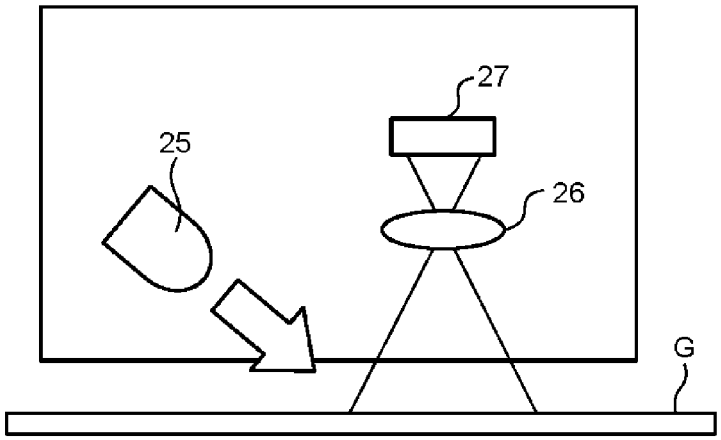
FIG. 6 is a view for explaining an automatic grain detecting operation of the image forming apparatus according to the first embodiment.
Figure 7:
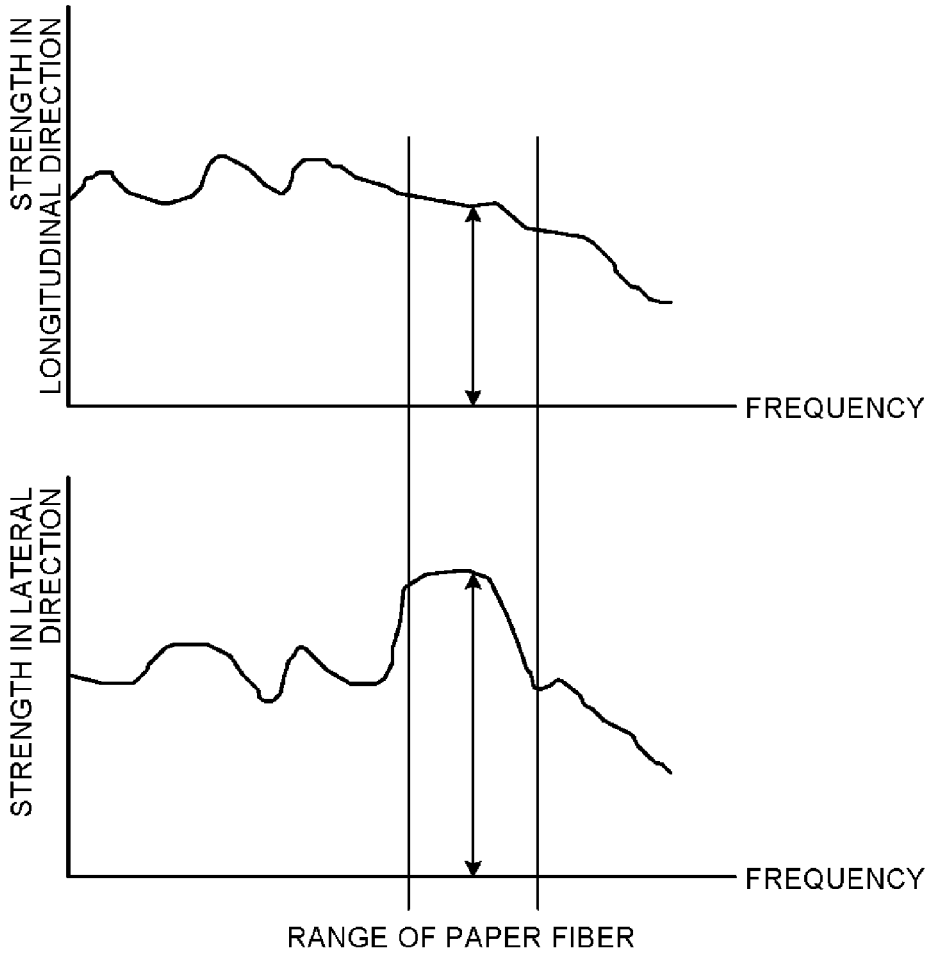
FIG. 7 is a graph of frequency characteristics for explaining the automatic grain detecting operation of the image forming apparatus according to the first embodiment.

Specifically, a light-emitting diode (LED) 25 irradiates the recording paper G with light as illustrated in FIG. 6. The reflected light is condensed with a lens 26 or the like, and the image of the recording paper G is captured by an image sensor 27, which is a complementary metal-oxide semiconductor (CMOS) sensor or the like. The CPU 101 uses the captured image obtained by the capturing of the image sensor 27 to compare the frequency in the longitudinal direction and the frequency in the lateral direction corresponding to the fibers of the recording paper G as illustrated in FIG. 7. The CPU 101 then registers a direction corresponding to a higher frequency, out of the frequency in the longitudinal direction and the frequency in the lateral direction, in the paper feeding tray information management unit 310 as the grain direction of the recording paper G. Thus, it is possible to more precisely acquire the grain direction of the recording paper to which the transparent color material is to be added. This can prevent the user from inputting a wrong grain direction. The CPU 101 is an example of a grain-direction detecting unit.

Figure 8:
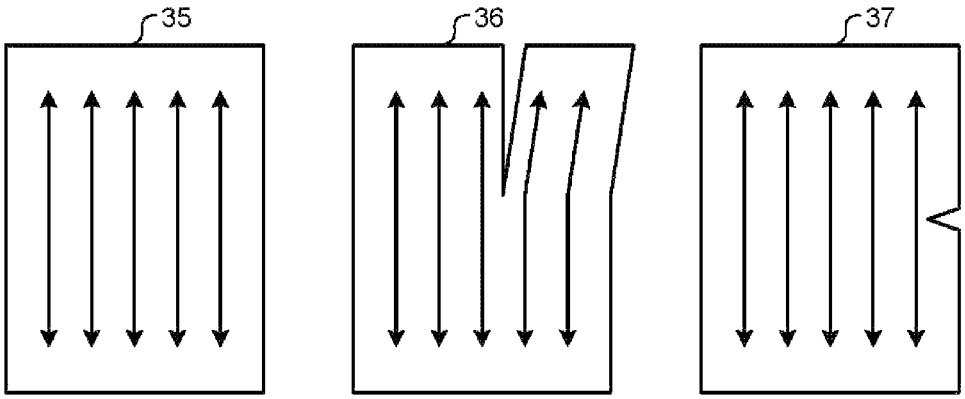
FIG. 8 is a view for explaining characteristics of recording paper that are determined by the grain.

Based on the grain direction of the recording paper, the pattern determining unit 306 determines the direction of a transparent color material pattern to be generated. The following describes the grain direction of the recording paper and the direction of the transparent color material pattern. As illustrated in recording paper 35 in FIG. 8, the grain of the recording paper is formed when paper fibers are caused to uniformly follow one direction when the paper is made. The recording paper is easily torn in the direction parallel to the grain direction as illustrated in recording paper 36 in FIG. 8. By contrast, the recording paper is hard to tear in the direction perpendicular to the grain direction as illustrated in recording paper 37 in FIG. 8.

Figure 9:
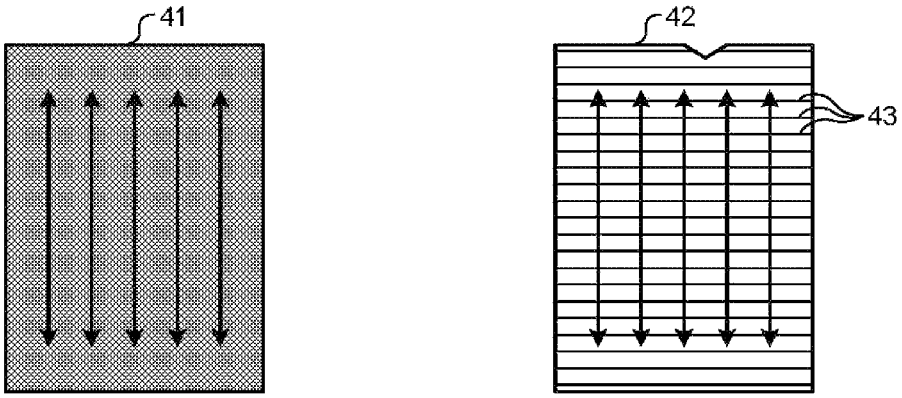
FIG. 9 is a view for explaining a formation direction of a transparent color material pattern in the image forming apparatus according to the first embodiment.

A transparent color material layer is uniformly formed on the surface of the recording paper as illustrated in recording paper 41 in FIG. 9. Thus, the transparent color material layer reinforces the recording paper 41, thereby making the recording paper 41 hard to tear regardless of the direction. In this case, however, the transparent color material layer is formed on the whole surface of the recording paper 41, resulting in consumption of an enormous amount of transparent color material.

To address this, the image forming apparatus 1 according to the first embodiment forms a transparent color material pattern 43 in the direction perpendicular to the grain direction, which is easily torn, as illustrated in recording paper 42 in FIG. 9. The transparent color material pattern 43 is made of the transparent color material and has a one-dimensional orientation. Thus, the transparent color material pattern 43 formed on the recording paper 42 functions to prevent a tear from widening along the grain direction.

Figure 10:
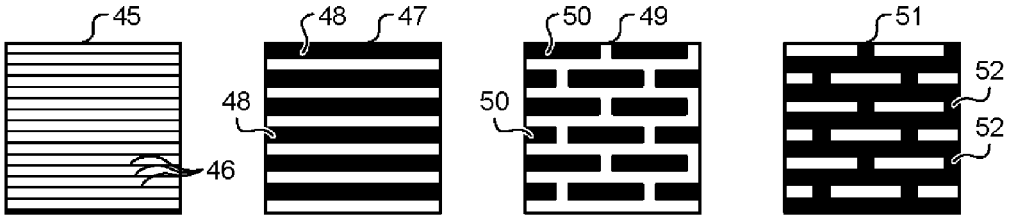
FIG. 10 is a view for explaining types of the transparent color material pattern in the image forming apparatus according to the first embodiment.

Examples of the transparent color material pattern having a one-dimensional orientation include a line pattern 46 formed of a plurality of thin lines with a width of equal to or smaller than 0.1 millimeters as in the case of the transparent color material pattern formed on recording paper 45 in FIG. 10. Examples of the transparent color material pattern also include a stripe pattern 48 formed of repeating lines with a width from 0.1 to several millimeters as in the case of the transparent color material pattern formed on recording paper 47 in FIG. 10.

The line pattern 46 and the stripe pattern 48 are not necessarily continuous. As illustrated in recording paper 49 in FIG. 10, for example, the transparent color material pattern may be a checkered pattern 50 formed of rectangular checkers. Alternatively, as illustrated in recording paper 51 in FIG. 10, the transparent color material pattern may be a reverse checkered pattern 52 obtained by reversing parts to which the transparent color material is applied and parts to which no transparent color material is applied in the checkered pattern 50.

In other words, the transparent color material pattern having a one-dimensional orientation is defined as a transparent color material pattern in which the pattern continues long in a first direction and the continuity in a second direction perpendicular to the first direction is shorter than the continuity in the first direction. With the transparent color material pattern having a one-dimensional orientation, the recording paper can be dotted with a number of parts to which no transparent color material is applied. This can reduce the consumption of the transparent color material.

The recording paper is hard to tear in the direction perpendicular to the grain direction because of the grain. In addition to this, the transparent color material pattern applied in the direction perpendicular to the grain direction can prevent a tear from widening along the grain direction. This can provide nearly the same reinforcing effect as that in the case where the transparent color material is applied to the whole surface of the recording paper.

The pattern generating unit 307 illustrated in FIG. 4 generates the transparent color material pattern illustrated in FIG. 10, for example, in a direction determined based on the grain direction of the recording paper on the protected area determined by the protected area determining unit 304. In the image processing unit 309, the transparent color material amount converting unit 303 converts the additional data received by the transmitting and receiving unit 301 into transparent color material amount data, and the pattern generating unit 307 generates the transparent color material pattern. The transparent color material amount data and the transparent color material pattern are supplied to the color material forming unit 308 in response to an input made by the user through the operation panel 107 illustrated in FIG. 3, for example.

Specifically, when no protection is made with the transparent color material, the transparent color material amount data of the transparent color material amount converting unit 303 is supplied to the color material forming unit 308. By contrast, when protection is made with the transparent color material, the transparent color material pattern of the pattern generating unit 307 is supplied to the color material forming unit 308. Alternatively, when protection is made with the transparent color material, the OR of the transparent color material amount data of the transparent color material amount converting unit 303 and the transparent color material pattern of the pattern generating unit 307 may be calculated and supplied to the color material forming unit 308, for example.

Figure 11:
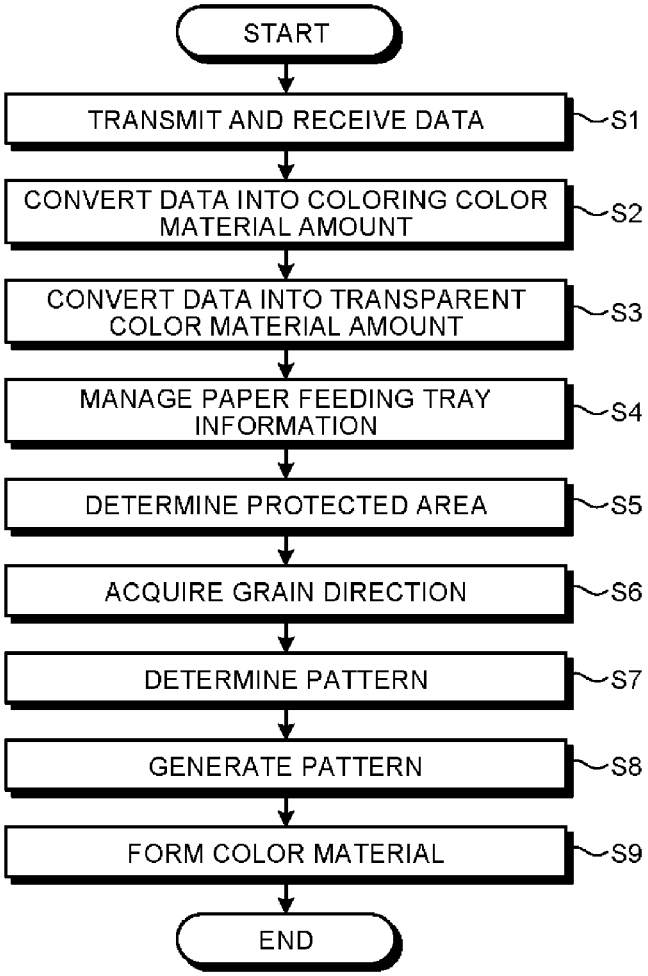
FIG. 11 is a flowchart of a forming operation of the transparent color material pattern in the image forming apparatus according to the first embodiment.

FIG. 11 is a flowchart of a forming operation of the transparent color material pattern on the recording paper in the image forming apparatus 1 according to the first embodiment. In the flowchart, the processing starts with turning-on of the main power supply of the image forming apparatus 1. At Step S1, the transmitting and receiving unit 301 (e.g., the network I/F 106) receives image data and additional data. An external information processor, such as a personal computer, creates a document with document creation software running thereon and transmits the document to be printed. The transmitting and receiving unit 301 establishes communications with the personal computer, thereby receiving the document as the image data and the additional data.

At Step S2, the coloring color material amount converting unit 302 converts the received image data into bitmap coloring color material amount data indicating the recording amount of the coloring color material. Similarly, at Step S3, the transparent color material amount converting unit 303 converts the received additional data into bitmap transparent color material amount data indicating the recording amount of the transparent color material.

At Step S4, the paper feeding tray information management unit 310 acquires and stores therein information indicating the size and the direction of the recording paper detected by the sheet sensor. At Step S4, the paper feeding tray information management unit 310 also stores therein the grain direction of the recording paper accommodated in the paper feeding tray 131 received from the user through the operation panel 107. If automatic detection of the grain direction explained with reference to FIG. 6 is performed, the paper feeding tray information management unit 310 stores therein the grain direction determined by comparing the frequencies in the longitudinal direction and the lateral direction of the image data as the grain direction of the recording paper.

Figure 5:
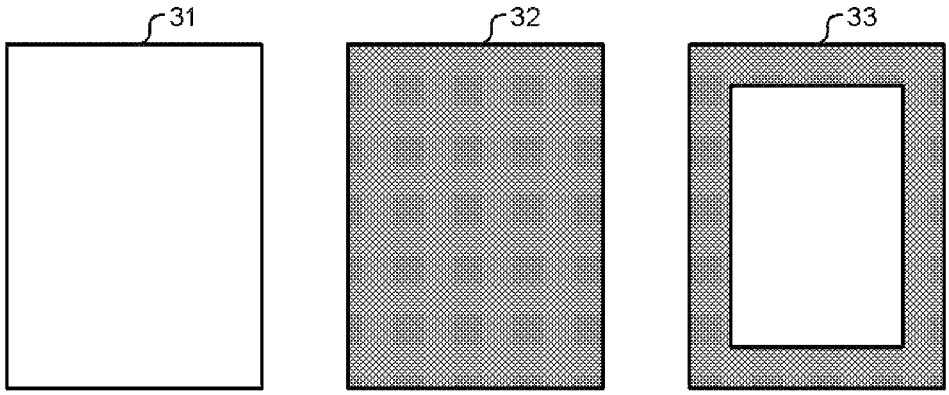
FIG. 5 is a view for explaining selection of a protected area of the image forming apparatus according to the first embodiment.

Subsequently, the user determines to make no protection with the transparent color material as in the cases of the recording paper 31 in FIG. 5 or to make protection with the transparent color material as in the cases of recording paper 32 and 33 in FIG. 5 by operating the operation panel 107. If the user determines to make protection with the transparent color material, the user selects a protection form to protect the whole surface as in the case of the recording paper 32 in FIG. 5 or a protection form to protect only the outer periphery as in the case of the recording paper 33 in FIG. 5 by operating the operation panel 107. In addition to the selection of the protection form with the transparent color material, the user also selects a desired paper feeding unit out of the paper feeding unit 13 and the paper feeding unit 16. At Step S5, the protected area determining unit 304 determines an area to be protected with the transparent color material based on the selection (input) made by the user and the size and the direction of the recording paper managed by the protected area determining unit 304.

At Step S6, the grain-direction acquiring unit 305 acquires the grain direction of the recording paper. Specifically, the grain-direction acquiring unit 305 acquires the grain direction of the recording paper corresponding to the paper-feeding unit selected by the user and stored at Step S4 from the paper feeding tray information management unit 310.

At Step S7, the pattern determining unit 306 determines the direction of a pattern to be generated based on the grain direction of the recording paper. Specifically, the pattern determining unit 306 sets the direction of the pattern to be generated to the direction perpendicular to the grain direction so as to make the recording paper hard to tear.

At Step S8, the pattern generating unit 307 generates a transparent color material pattern in the direction set at Step S7 on the protected area determined at Step S5. The transparent color material pattern is any one of the transparent color material patterns illustrated in FIG. 10, for example. Naturally, another transparent color material pattern may be generated. A new transparent color material pattern is preferably generated as a transparent color material pattern having a one-dimensional orientation as described above.

At Step S9, the color material forming unit 308 uses the coloring color material amount data obtained by the conversion at Step S2 and other data to form a color material image on the recording paper. At Step S9, the color material forming unit 308 also uses the transparent color material amount data, which is obtained by the conversion made by the transparent color material amount converting unit 303 at Step S3 in response to an input made by the user through the operation panel 107, to form a transparent image on the recording paper. Alternatively, the color material forming unit 308 uses the transparent color material pattern generated by the pattern generating unit 307 at Step S8 to form a transparent image on the recording paper. Thus, the processing of the flowchart in FIG. 11 is terminated.

As described above, the image forming apparatus 1 according to the first embodiment adds a transparent color material when recording an image on recording paper. Specifically, the image forming apparatus 1 performs determining an area on the recording paper to which the transparent color material is to be added and acquiring the grain direction of the recording paper to which the transparent color material is to be added. The image forming apparatus 1 also performs determining, based on the acquired grain direction, the direction of a pattern to be generated and generating the pattern in the determined direction on the determined area of the recording paper. This can reduce the consumption of the transparent color material without reducing the reinforcing effect in protection of the image and the recording paper.

In other words, the image forming apparatus 1 according to the first embodiment determines a pattern having a one-dimensional orientation based on the acquired grain direction of the recording paper in an image recording device that adds the transparent color material when recording an image on the recording paper. Because the transparent color material is applied based on the determined pattern, the image forming apparatus 1 can make the one-dimensionally orientated pattern formed with the transparent color material and the grain direction perpendicular to each other. If the one-dimensionally orientated pattern formed with the transparent color material is perpendicular to the grain direction, the protection performance in protection of the image and the recording paper is nearly the same as that in the case where the transparent color material is uniformly applied. This can prevent deterioration in the protection performance. The use of a pattern having a one-dimensional orientation makes it possible to significantly reduce the consumption of the transparent color material.

The image forming apparatus 1 according to the first embodiment includes the operation panel 107 used to input the grain direction of the recording paper accommodated in the paper feeding unit 13 or the paper feeding unit 16. The image forming apparatus 1 further includes the paper feeding tray information management unit 310 that manages the grain direction of the recording paper accommodated in the paper feeding unit 13 or the paper feeding unit 16. With this configuration, the image forming apparatus 1 can acquire the precise grain direction of the recording paper corresponding to the paper feeding unit 13 or 16 selected by the user from the paper feeding tray information management unit 310.

In the example above, the grain direction acquiring unit 305 acquires the grain direction of the recording paper accommodated in the paper feeding tray 131 of the paper feeding unit 13 or 16 input by the user in advance and the grain direction corresponding to the paper feeding unit 13 or 16 selected by the user. Typically, the grain of recording paper frequently extends in the longitudinal direction with the recording paper in a portrait orientation. Thus, the grain direction acquiring unit 305 may acquire the grain direction corresponding to the direction of the recording paper set in the paper feeding tray 131 without depending on the input of the grain direction made by the user. In the image forming apparatus 1 according to the first embodiment, the paper feeding tray information management unit 310 can manage the direction of the recording paper set in the paper feeding tray 131. This can facilitate acquisition of the grain direction of the recording paper to which the transparent color material is to be added.

Second Embodiment

Figure 12:
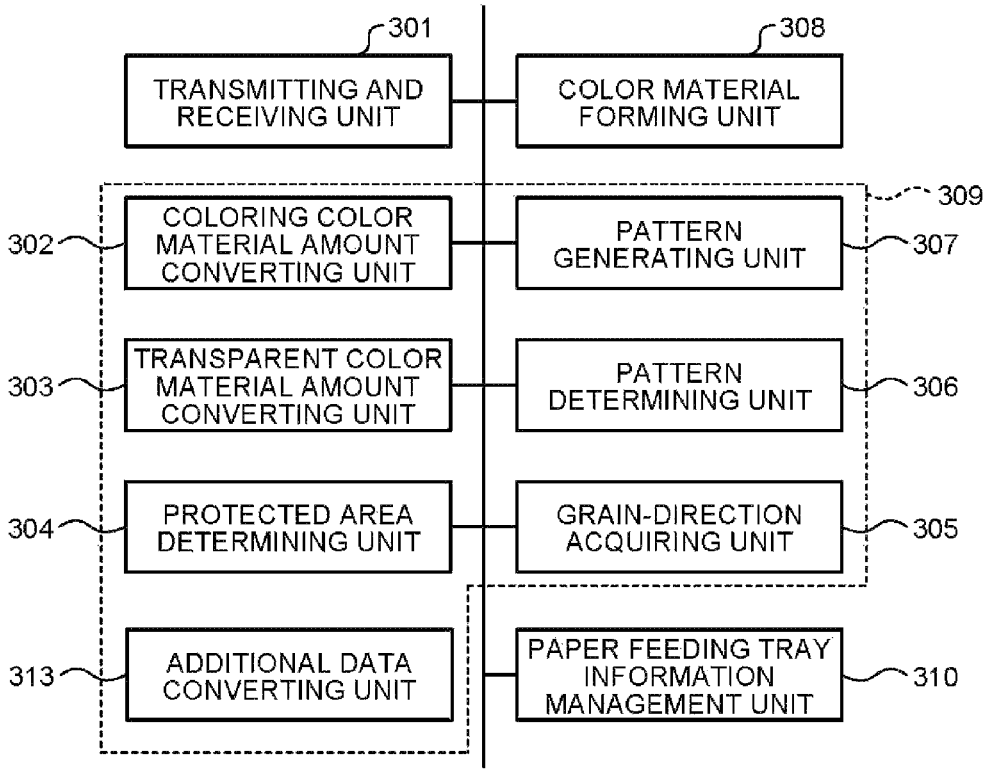
FIG. 12 is a functional block diagram of an image forming apparatus according to a second embodiment.

An image forming apparatus according to a second embodiment of the present invention will be described. The image forming apparatus according to the second embodiment is an example where the apparatus uses a partial printing area in a printing area and additional data indicating an effect to be produced by a transparent color material on the partial printing area. FIG. 12 is a functional block diagram of the image forming apparatus according to the second embodiment. In FIG. 12, components that perform operations similar to those of the functional blocks of the image forming apparatus 1 according to the first embodiment are denoted by like reference numerals. The following describes the difference between the first and the second embodiments, and overlapping explanations will be omitted.

As illustrated in FIG. 12, the image forming apparatus according to the second embodiment includes an additional data converting unit 313 in the image processing unit 309 besides the above described components, the transmitting unit 301 to the paper feeding tray information management unit 310. The functions of the units 301 to 313 may be provided as software by the CPU 101 of the control unit 10 operating in accordance with the computer program stored in the ROM 102 illustrated in FIG. 3. Alternatively, some or all of the functions of the units 301 to 313 may be provided as hardware.

In FIG. 12, the transmitting and receiving unit 301 that can be provided as the network I/F 106 receives image data and additional data transmitted from an information processor, for example. In this embodiment, image data is information indicating an image to be formed on recording paper with a coloring color material. Image data is bitmap or vector data represented by an RGB or CMYK color system or a monochrome grayscale system, for example. Additional data is information indicating an effect to be formed on recording paper with a transparent color material. Additional data is bitmap or vector data represented by a monochrome grayscale system, for example.

Figure 13:
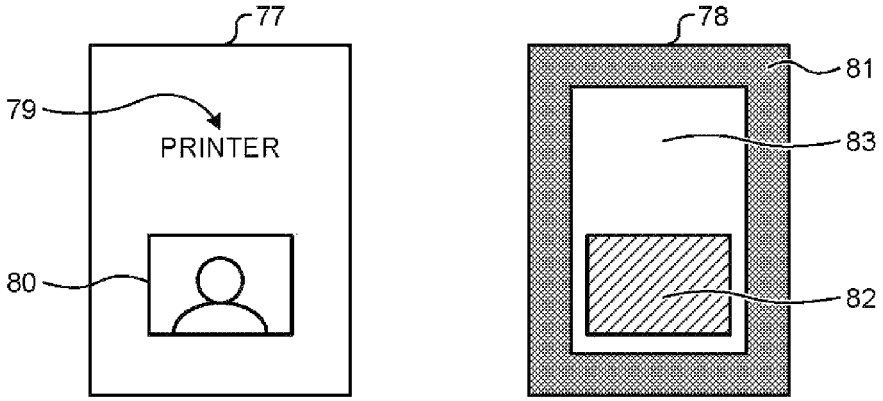
FIG. 13 is a view for explaining characteristic of additional data used in the image forming apparatus according to the second embodiment.

FIG. 13 illustrates an example of a schematic image 77 corresponding to the image data received from the information processor or the like and a schematic image 78 corresponding to the additional data. As illustrated in the schematic image 77, the image data includes a character object 79 and a photo object 80. As illustrated in the schematic image 78, the additional data includes a protected area 81 on which protection of an image and the recording paper is made with the transparent color material, a gloss area 82 to be highly glossed, and an area 83 on which no processing is performed. In other words, the additional data indicates an effect to be produced by the transparent color material on a partial printing area.

In this example, the gloss area 82 is determined such that the photo object 80 is to be highly glossed. In this example, the protection form to protect only the outer periphery of the recording paper is selected.

The additional data converting unit 313 converts the additional data received by the transmitting and receiving unit 301 into bitmap data indicating an effect to be produced by the transparent color material. More specifically, the additional data converting unit 313 develops the vector additional data into a bitmap. The bitmap additional data obtained by the conversion is supplied to the transparent color material amount converting unit 303 and the protected area determining unit 304.

The transparent color material amount converting unit 303 extracts the gloss area 82 from the bitmap additional data obtained by the conversion and converts the gloss area 82 into transparent color material amount data. The transparent color material amount data is derived by using the recording amounts of the coloring color materials of C (cyan), M (magenta), Y (yellow), K (black), and the like obtained by conversion made by the coloring color material amount converting unit 302 and calculating "Transparent Color Material Amount=Total Amount Regulating Value−Recording Amount Of CMYK", for example. The total amount regulating value is the sum of the recording amounts of the transparent color material and the coloring color materials that is recordable on the recording paper. When the transparent color material amount takes a negative value, the amount is considered to be 0, whereas when the transparent color material amount exceeds its recordable value (the maximum value), the amount is considered to be the maximum value.

Based on the calculation result, the transparent color material is applied on the image formed with the coloring color material on the recording paper such that the sum of the recording amounts is equalized. This can reduce unevenness on the image surface, thereby increasing the glossiness of the image while maintaining the colors of the image.

The protected area determining unit 304 determines an area to be protected with the transparent color material. The protected area determining unit 304, for example, extracts the protected area 81 from the bitmap additional data obtained by the conversion and determines the protected area 81 to be the area to be protected with the transparent color material. The grain-direction acquiring unit 305, the pattern determining unit 306, and the pattern generating unit 307 operate in the same manner as in the description above.

The OR of the transparent color material amount data of the transparent color material amount converting unit 303 and the transparent color material pattern of the pattern generating unit 307 is calculated and supplied to the color material forming unit 308, for example. The color material forming unit 308 uses the recording amounts, which are obtained by the conversion made by the image processing unit 309, to form a color material image on the recording paper.

As described above, the image forming apparatus according to the second embodiment uses the additional data to specify an effect to be produced by a transparent color material on each partial printing area. This enables the user to skip a selection operation to determine whether to make protection with the transparent color material and a selection operation to determine a protection form with the transparent color material made by the user through the operation panel 107, for example. The second embodiment can provide advantageous effects similar to those in the first embodiment, including reduction in the consumption of the transparent color material without reducing the reinforcing effect in protection of an image and the recording paper.

The present embodiments, for example, may be applied to a system including a plurality of devices (e.g., a printer controller and a printer). An object of the present embodiments are obviously achieved by supplying a storage medium (or a recording medium) having a program code of software recorded therein that provides the functions of either of the embodiments above to a system or an apparatus and by a computer (or a CPU or an MPU) of the system or the apparatus reading and executing the program code stored in the storage medium. In this case, the program code itself, which is read from the storage medium, provides the functions of either of the embodiments above. The storage medium having the program code stored therein serves as one of the embodiments.

The functions of the embodiments above are not necessarily provided by a computer executing the read program code. In response to instructions of the program code, an operating system (OS) running on the computer performs a part or all of actual processing, for example. The processing obviously provides the functions of the embodiments above. The present embodiments can reduce the consumption of a transparent color material without reducing a reinforcing effect for recording paper and an image.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image processing apparatus comprising:

a protected area determining unit that determines a protected area to be protected by forming a transparent color material pattern made of a transparent color material on recording paper;

a grain-direction acquiring unit that acquires a grain direction of the recording paper;

a pattern determining unit that determines a direction of the transparent color material pattern based on the acquired grain direction;

a pattern generating unit that generates the transparent color material pattern in the determined direction; and a color material forming unit that forms the transparent color material pattern in the determined direction on the protected area of the recording paper.

2. The image processing apparatus according to claim 1, further comprising:

an input unit that is used to perform an input operation, wherein the protected area determining unit determines a protected area specified through the input unit as the protected area to be protected with the transparent color material pattern.

3. The image processing apparatus according to claim 2, further comprising:

an information management unit that manages information input through the input unit and indicating a grain direction of the recording paper stored in a storage unit, wherein the grain-direction acquiring unit acquires the grain direction of the recording paper from the information management unit, and the pattern determining unit determines the direction of the transparent color material pattern based on the grain direction acquired by the grain-direction acquiring unit.

4. The image processing apparatus according to claim 1, further comprising:

an image sensor that captures an image of the recording paper; and a grain-direction detecting unit that compares a frequency in the longitudinal direction and a frequency in the lateral direction corresponding to fibers of the recording paper in the image of the recording paper captured by the image sensor, thereby detecting the direction corresponding to the higher frequency as the grain direction of the recording paper.

5. The image processing apparatus according to claim 1, further comprising:

a receiving unit that receives partial printing areas on the recording paper and additional data indicating effects to be produced by the transparent color material on the respective partial printing areas, wherein the color material forming unit applies the effects with the transparent color material on the respective partial printing areas.

6. An image processing method comprising:

determining, by a protected area determining unit, a protected area to be protected by forming a transparent color material pattern made of a transparent color material on recording paper;

acquiring, by a grain-direction acquiring unit, a grain direction of the recording paper;

determining, by a pattern determining unit, a direction of the transparent color material pattern based on the acquired grain direction;

generating, by a pattern generating unit, the transparent color material pattern in the determined direction; and forming, by a color material forming unit, the transparent color material pattern in the determined direction on the protected area of the recording paper.

7. A computer program product comprising a non-transitory computer-readable medium having computer readable program codes, performed by a computer, the program codes when executed causing the computer to execute:

determining a protected area to be protected by forming a transparent color material pattern made of a transparent color material on recording paper;

acquiring a grain direction of the recording paper;

determining a direction of the transparent color material pattern based on the acquired grain direction;

generating the transparent color material pattern in the determined direction; and forming the transparent color material pattern in the determined direction on the protected area of the recording paper.

* * * * *